US005664855A

United States Patent [19]

Lautenschläger et al.

[11] Patent Number: 5,664,855

[45] Date of Patent: Sep. 9, 1997

[54] FITTING FOR THE ADJUSTABLE-HEIGHT MOUNTING OF DRAWERS

[75] Inventors: Horst Lautenschläger, Reinheim; Horst Berger, Stuckenbrock-Schloss Holte; Gerhard Lautenschläger, Brensbach-Wersau, all of Germany

[73] Assignee: MEPLA-Werke Lautenschläger GmbH & Co. KG, Germany

[21] Appl. No.: 714,860

[22] Filed: Sep. 17, 1996

Related U.S. Application Data

[63] Continuation of Ser. No. 377,465, Jan. 24, 1995, abandoned.

[30] Foreign Application Priority Data

Apr. 26, 1994 [DE] Germany ..... 44 14 462.8

[51] Int. Cl.[6] ..... A47B 88/00

[52] U.S. Cl. ..... 312/334.4; 312/334.1; 312/334.5; 312/330.1

[58] Field of Search ..... 312/330.1, 332, 312/334.1, 334.27, 334.38, 334.4, 334.9, 334.5, 334.7, 334.8, 334.13, 334.14

[56] References Cited

U.S. PATENT DOCUMENTS

| | | | |
|---|---|---|---|
| 2,739,864 | 3/1956 | Saunders | 312/334.4 |
| 4,244,546 | 1/1981 | Mertes et al. | 312/334.4 X |
| 4,653,821 | 3/1987 | Faust | 312/334.38 |
| 4,810,045 | 3/1989 | Lautenschlager | 312/334.38 X |
| 5,375,922 | 12/1994 | Brustle et al. | 312/334.4 |
| 5,439,283 | 8/1995 | Schroder et al. | 312/334.4 |
| 5,588,729 | 12/1996 | Berger | 312/330.1 X |

FOREIGN PATENT DOCUMENTS

| | | | |
|---|---|---|---|
| 439774 | 8/1991 | European Pat. Off. | 312/330.1 |
| 545329 | 6/1993 | European Pat. Off. . | |
| 7024640 | 9/1970 | Germany . | |
| 2422408 | 10/1975 | Germany | 312/334.5 |
| 8627618 | 1/1987 | Germany . | |
| 4114708 | 11/1992 | Germany | 312/334.1 |
| 9300260 | 4/1993 | Germany . | |
| 9304521 | 7/1993 | Germany . | |

*Primary Examiner*—Peter M. Cuomo
*Assistant Examiner*—James O. Hansen
*Attorney, Agent, or Firm*—Londa and Traub LLP

[57] ABSTRACT

The present invention is a fitting for the adjustable-height mounting of drawers on the runner rails of drawer slides, which support them on the bottom. On the runner rail of each drawer slide a slider is provided with a bearing surface facing the drawer bottom, and can be shifted parallel to the runner rails by a given amount. The slides are inclined, however, such that the bearing surface of the slider will be substantially flush with the drawer bottom or even below the drawer bottom when the drawer is supported on the runner rail in the properly installed position. But in the other end position the slider is shifted upward by the amount desired for the adjustment.

15 Claims, 3 Drawing Sheets

FITTING FOR THE ADJUSTABLE-HEIGHT MOUNTING OF DRAWERS

This application is a continuation of application Ser. No. 08/377,465, filed Jan. 24, 1995 now abandoned.

The invention relates to a fitting for the vertically adjustable mounting of drawers on the rails of drawer guides which support the drawers from the bottom.

BACKGROUND OF THE INVENTION

Such drawer guides, whose runner rail supports the drawer at the drawer bottom, are known for example in a form in which the guide rail fastened to the carcase wall reaches from below into the corresponding runner rail that is formed by an inverted channel removably fastened to the drawer. Inside of the runner tracks are provided for rollers held in an elongated cage. The rollers can roll on the tracks of the guide rail on the one side and on associated parts of the inside surface of the runner rail, thus permitting longitudinal displacement of the runner rail relative to the guide rail. Due to their high transverse stability when the drawer is in the extended state, and the possibility of arranging the runner rail under the drawer bottom so as to be invisible when the drawer is open, drawer guides of this kind have been used increasingly in recent years. At its end inside the carcase the runner rail is fastened by a hook projecting upward from the runner rail behind the drawer back and inserted into a substantially horizontal bore in the drawer back. Fastening at the front is achieved by a holding pin inserted into a bore in the front part of the edge of the associated drawer side, projecting from the upper side of a holding lug reaching under the drawer side and fastened to the runner rail (published German Patent Application 36 41 325). Since the holding pin is inserted into the associated bore in the drawer side from below, the drawer can be removed from the runner rail relatively simply by raising the front end of the drawer in the extended state far enough to release the holding pin from the bore, and then the drawer is pulled forward, i.e., in the opening direction, off from the hook inserted into the drawer back.

In today's mass production, drawers and their cabinets are as a rule made separately and not assembled until after orders are received. On account of precision production and the fact that the furniture wall materials have little tendency to shrink or expand, the installation of drawers in a cabinet can be performed as a rule without difficulty, by mounting drawer guides on the inside surfaces of cabinet walls and then fastening the runner rails to the drawers. Under unfavorable circumstances, when for example in the manufacture of the carcase and drawers inaccuracies occur in the dimensions, or in the case of distortion due to external influences (drying out or aging), it can happen that fastening the runner rail to a drawer in the simple manner described becomes difficult or impossible because the lateral distance apart of the two runner rails of the drawer does no longer agree precisely with the distance between those parts of the guide rails that are to be engaged by them. To create the possibility of compensation it has already been proposed to make the holding pin displaceable to a given extent on the lug holding it transversely of the direction of movement of the drawer, thus permitting adjustments in the horizontal direction. In further development of this known transversely adjustable mounting of a runner rail (German published patent application 41 14 708) it has also been proposed to create a vertical adjustment of the drawer in addition to the transverse adjustment by providing a tap in the lug that displaceably holds the holding pin, at a distance from the holding pin, containing a screw which thrusts through a pressure plate against the bottom edge of the drawer side. By turning the screw upwards or downwards a change can be made in the support of the drawer side with respect to the lug and thus with respect to the runner rail, i.e., the level of the drawer in the front area. This adjustment in level is possible only with a screwdriver from the bottom of the open drawer, which presents difficulties in the case of bottom drawers. In the latter case the drawer must be removed for this purpose and the more easily accessible screw can then be turned to the desired setting, and then the drawer has to be mounted again on the runner rails and the result of the adjustment can be checked. It is apparent that this manner of achieving the level adjustment is inconvenient and complicated.

The invention, on the other hand, is addressed to the problem of creating a simple drawer level adjustment that can be performed without tools and which will be independent of any transverse adjustment.

SUMMARY OF THE INVENTION

This problem is solved according to the invention in that on the runner rail of the drawer slide a slider having a supporting surface facing the drawer bottom is provided on the runner rail of the drawer guide, and can be displaced over a given length but at an angle to the drawer-opening direction such that the supporting surface of the slider is substantially flush or even below the bottom of the drawer when the drawer is held on the runner rail in the proper installed position, but in the other displacement position it is shifted upward in relation thereto by the desired amount of vertical adjustment.

In a preferred embodiment of the invention, the slider is in the form of an elongated body provided over the greatest part of its length with a guiding slot running at an angle with respect to its supporting surface in the direction of displacement, and at least one guide means projecting from the associated runner rail is engaged in this guiding slot. A configuration is recommended in which the guide slot is open on the two opposite vertical lateral surfaces of the slider, so that the same slider can be used on either runner rail on the right or left side of the drawer.

At both ends, the guiding slot is best closed so as to give the slider the necessary stability.

It is expedient to make the guiding slot rectilinear over its entire length, and then the guide means can be in the form of a substantially rectangular plate whose thickness is no more than equal to the distance between the confronting walls defining the guiding slot. The slider is then mounted on the runner rail simply by pushing the guiding slot of the slider onto the rectangularly defined plate-like guide means.

The plate forming the guide means is then provided, at least on one of its longitudinal sides, with mounting means whereby the plate can be fastened with the desired inclination on the corresponding runner rail.

In one of the confronting faces of the plate constituting the guide means on the one hand, and in the associated slot-defining wall on the other, it is expedient to provide a serration running transversely of the direction of displacement and at least one, preferably several, narrow transverse ribs tapering toward their free end and spaced apart from one another in the direction of displacement. The free ends of the ribs thus cooperate with the transverse serration to the effect that the slider is adjustable corresponding to the pitch of the serration.

The serration is in that case preferably provided on the underside, remote from the drawer bottom, of the plate forming the guiding means, and the transverse rib(s) are provided on the boundary surface facing it of the guiding slot. The weight of the drawer is thus transferred through the bearing surface of the slider and the upper boundary of the guiding slot to the unserrated upper side of the plate-like guiding means.

To enable a vertical adjustment to be made as simply as possible, it is expedient, if the elongated body forming the slider is made concavely curved at its front and back ends. To make a vertical adjustment the person performing the adjustment grasps the slider between the thumb and index finger; the curved ends prevent them from slipping off.

In addition, the concavely curved ends can also be provided with a profile that will further prevent the fingers grasping the slider from slipping off.

In a preferred embodiment the slider is an injection-molded plastic piece, although it could, of course, be made of metal, by die-casting for example.

The guide means are on the other hand made preferably of metal, and then at least one short pin, attached directly or indirectly, is formed on them, which is riveted or upset in an associated bore in the wall of the runner rail.

BRIEF DESCRIPTION OF THE DRAWINGS

The invention will be explained in the following description of an embodiment, in conjunction with the drawing, wherein.

DETAILED DESCRIPTION OF THE INVENTION

Figure 1:
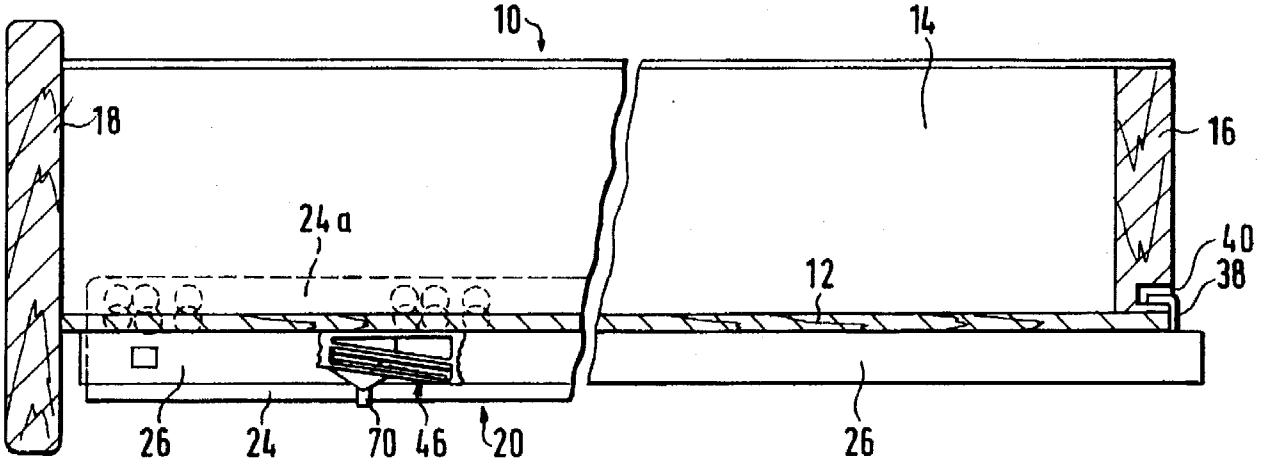
FIG. 1 is a longitudinal central section through a drawer whose runner rail, visible under the drawer bottom, is held on the drawer bottom by a fitting configured in the manner of the invention, the fitting being represented in the end position in which the drawer has been lowered to the upper side of the runner rail.
Figure 2:
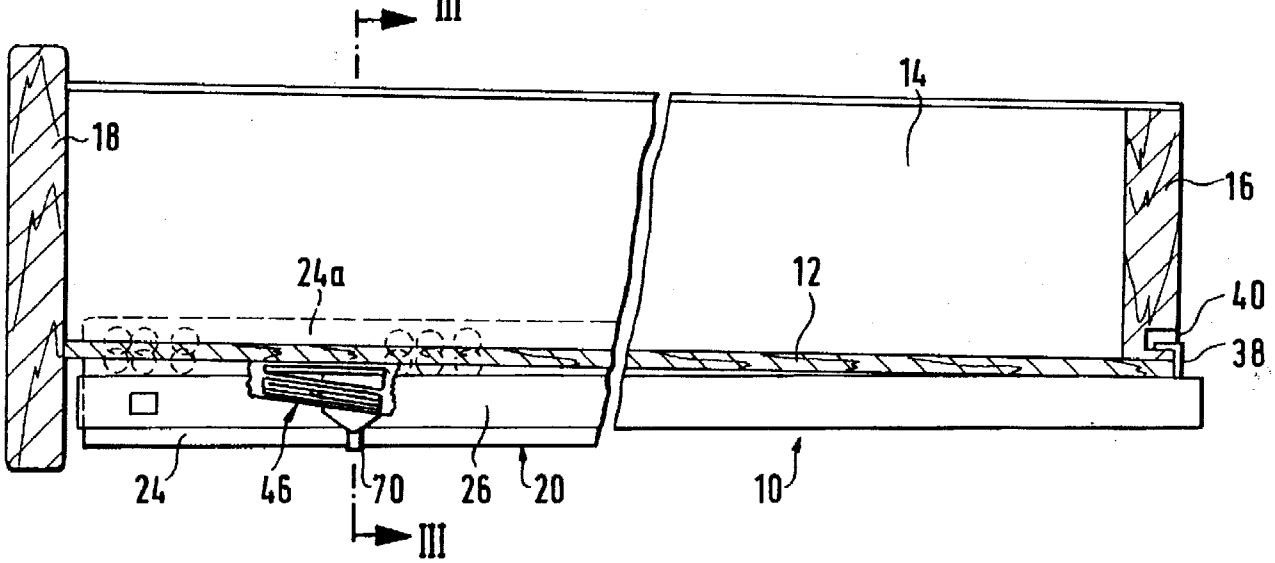
FIG. 2 is a sectional view corresponding to FIG. 1, in which the fitting is represented in the other end position wherein the drawer is shifted upward by the maximum vertical adjustment.

In FIGS. 1 and 2 there is shown a drawer generally identified by the number 10, substantially in a longitudinal central section, which as usual has a bottom 12 to whose lateral longitudinal margins drawer sides 14 are attached, which at the bottom extend slightly beyond the bottom 12. To the back margin is attached the drawer back 16 and to the front margin is attached the larger drawer front 18. On the underside of the drawer bottom 12 the drawer slides 20 of basically known kind are disposed along the drawer sides 14 and they consist of the guide rails 24 fastened to the inside of the cabinet walls 22, plus the runner rails 26 which are made in the manner seen in FIG. 3. The guide rail 24, in this representation, is channel-shaped from sheet metal, and its one flange forms a flat **24*a* provided with screw holes, not represented, which can be screwed onto the inner side of the drawer side 22, while its other flange is shaped at its free end such that it has races within the runner rail 26 to be described below which run parallel and at a distance from the flat 24*a* for cylindrical rollers 28 rolling on an upper race, and rows of balls 30 rolling in two hollowed races spaced apart horizontally. The rollers 28 and balls 30** are held in their mutual relationship and alignment by an appropriately shaped cage of plastic which is not represented.

The runner rail 26 is, in turn, made in the form of a channel provided on the drawer bottom to accommodate the side of the guide rail 24 provided with races, and having a profile of such cross-sectional shape that the rollers 28 and the balls 30 are clutched, so that the inside surfaces of the runner rail 26 serve also as races in the areas in contact with the bearings.

Figure 3:
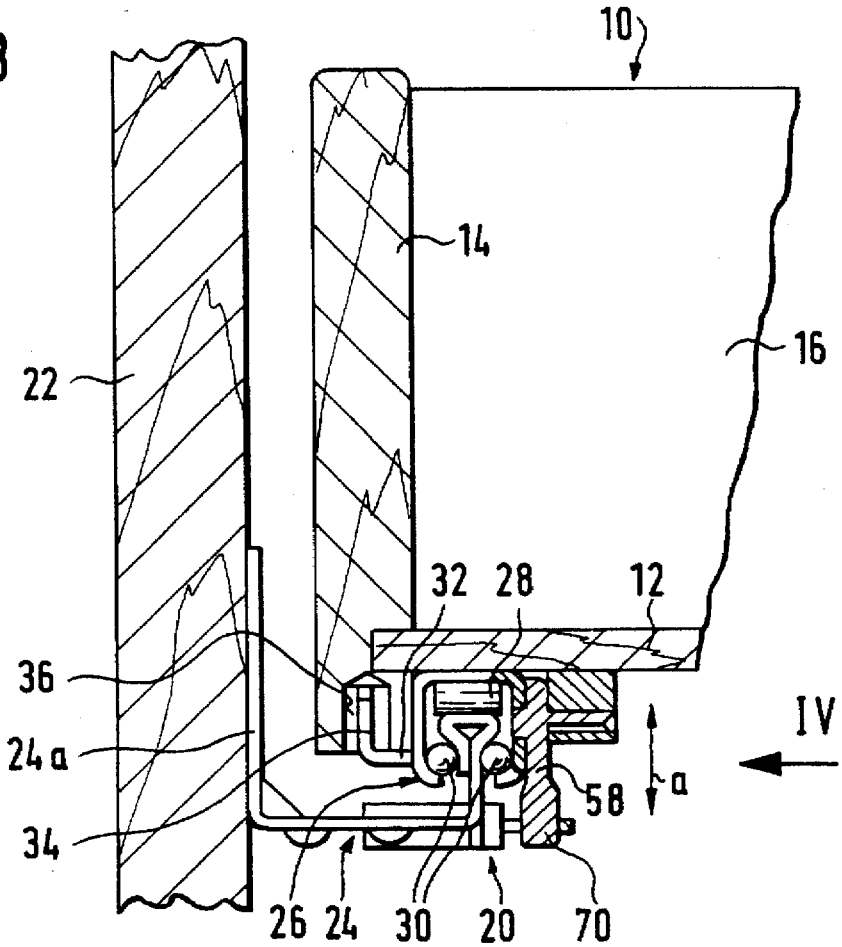
FIG. 3 is an enlarged sectional view as seen in the direction of the arrows 3—3 in FIG. 2.

The runner rail 26 is fastened to the drawer 10 in the position seen in FIGS. 1 and 2, and especially in FIG. 3, underneath the drawer bottom 12 and alongside the inner surfaces of the drawer sides 14 below the drawer bottom 12, while for the purpose of fastening it in the front area a lateral horizontal lug 32 having on its end a hook portion 34, the hook fitting into an associated bore 36 in the bottom edge of the drawer side 14. At its back end, i.e., the end inside the cabinet, the runner rail 26 extends a bit further past the drawer back 16 where it has a mounting hook 38 which is composed of a portion extending upwardly from the upper horizontal wall of the runner rail and a horizontal portion bent forward therefrom at right angles, i.e., away from the cabinet interior, and which can be inserted into a bore 40 in the drawer back 16 in the manner seen in FIGS. 1 and 2. It is apparent that the drawer resting in this manner on the upper side of the flange of runner rail 26 can be removed from the runner rail by raising the drawer at its front end until the hook 34 comes free of the associated bore 36. Then the drawer can be removed forwardly from the horizontal portion of the mounting hook 38 and from the runner rail. It is to be noted in this connection that the front end of the drawer is not fixed in the vertical direction on the hook portion 34, but is held only by its own weight on the hook, while its actual support is provided by the drawer bottom 12 lying on the runner rail.

Figure 4:
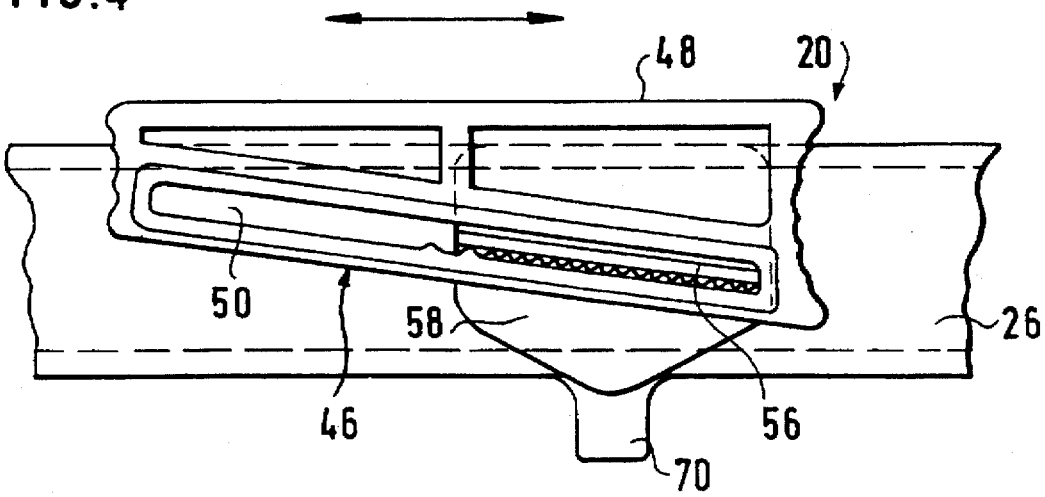
FIG. 4 represents a view of the fitting mounted on the runner rail, as seen in the direction of arrow 4 in FIG. 3.

For the vertical adjustment of the drawer 10 at its front end a slider 46 is mounted on the lateral surface of the runner rail 26 facing away from its associated drawer side 14 so as to be displaceable to a certain extent lengthwise. It has on the upper side a bearing surface 48 which is just flush in its one end position with the surface of the web of the runner rail 26, i.e., it is in contact with the bottom of the drawer bottom 12. This position of the slider 46 is represented in FIG. 1, while the other displacement end position is represented in FIG. 2. As it can be seen from the enlarged views in FIG. 4 representing the slider 46 in the end position represented in FIG. 2 underneath the bearing surface 48 and FIGS. 5 and 6, a guide slot 50 sloping away from the bearing surface 48 in the direction of displacement is provided in the slider, which is made of plastic by injection molding, and it extends substantially through the full length of the elongated slider 46; it is open on both sides but closed at its ends. Into the guide slot 50 enters a guide means 56 in the form of a substantially rectangularly defined plate laterally attached to the runner rail 26 and having a thickness no more than equal to the distance between the opposite walls defining the guide slot 50. This flat guide means 56 is shorter than the length of the slot 50, so that the slider is displaceable on the guide means 56. The plate-like metal guide means 56 bent away from a mounting plate 58 which can be fastened in contact with this surface of the runner rail is inclined at the same angle as the guide slot 50, so that the slider 46 will undergo a change in level in the event of a longitudinal shift within the given range of displacement. That is to say, a displacement of the slider 46 from the end position shown in FIG. 1 in the direction away from the cabinet interior to the end position shown in FIG. 2 will result in a component of the movement of the bearing surface 48 in the direction of the arrows a in FIG. 3, i.e., in the upward and downward direction, which means that at the same time the drawer bottom 12 resting on the bearing surface, and with it the drawer 10, will be raised or lowered as a whole in the drawer-front area. That is to say, by the appropriate displacement of the slider 46, it is possible to change the level of the front end of the drawer, while the back end is held on the runner rail in the original mounted position by the mounting hook 38. Once the vertical adjustment is made, to secure it there is provided a serration 60 of closely arranged transverse notches, and on the confronting bottom wall of the guide slot 50 two narrow, transverse teeth 62 are formed, which taper toward their free end, and which produce a detent in cooperation with the notches 60. Since the slider 46 is made of a resilient plastic, the portion of the slider defining the bottom side of the guide slot 50 can flex slightly downward, so that by exerting a sufficiently strong displacement pressure on one of the two end surfaces 64 the interlocking between the notches 60 and the teeth 62 can be overcome.

Figure 5:
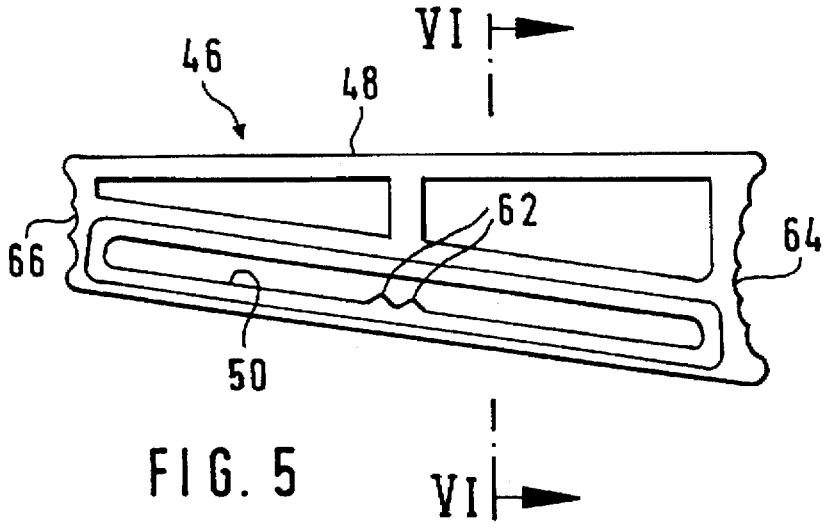
FIG. 5 is a view in the same viewing direction as in FIG. 4, of the slider of the fitting according to the invention.
Figure 6:
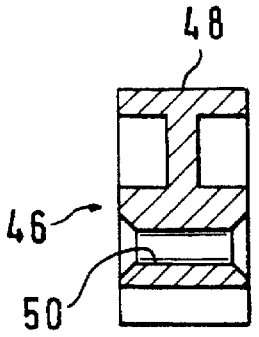
FIG. 6 is a sectional view seen in the direction of the arrows 6—6 in FIG. 5.
Figure 7:
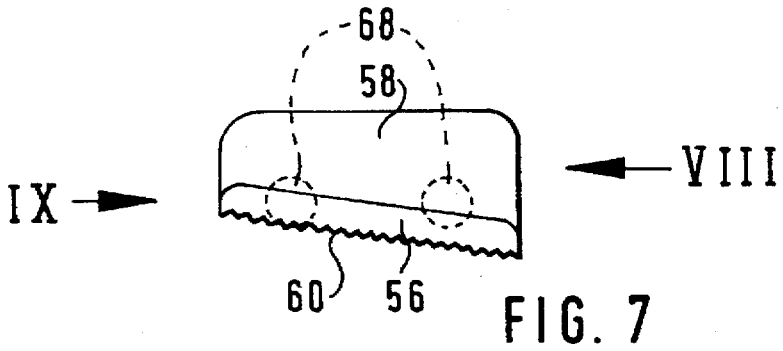
FIG. 7 is a side elevation of the guide means holding the slider for displacement on the runner rail.
Figure 9:
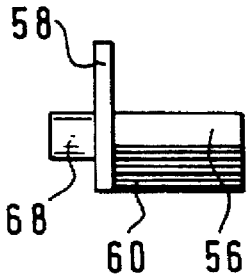
FIG. 9 is a view of the guide means seen in the direction of arrow 9 in FIG. 7.
Figure 8:
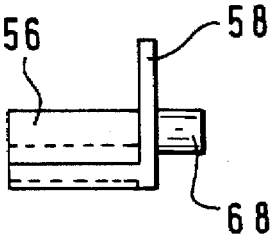
FIG. 8 is a view of the guide means seen in the direction of arrow 8 in FIG. 7.

The inside and outside extremities of the slider 46 have a curved shape and are also provided with indentations to prevent finger slippage, as it can be seen especially in FIGS. 4 and 5.

The guide means 56 is fastened to the runner rail 26 through the lateral mounting plate 58 which is in contact with the lateral surfaces of the runner rail, as indicated. Two short pins 68 project integrally from the engaged surface of the mounting plate 58 and are inserted into holes in the associated flange of the runner rail, and then they are riveted or upset from the inside of the runner rail. In FIGS. 1 to 4 a downwardly projecting short lug 70 is represented; it has nothing to do with the operation and construction of the fitting that serves for the level adjustment, but which serves a purpose in cooperating with an automatic drawer closer mechanism which is not subject matter of the present application.

What is claimed is:

1. A fitting for the adjustable-height mounting of a drawer on a runner rail of a drawer slide supporting the drawer at a drawer bottom, said drawer having an opening direction, said fitting comprising:

a movable slider comprising an elongated body having an elongated bearing surface for contacting the bottom of the drawer, the elongated body having a longitudinal guide slot running at an incline with respect to the bearing surface, and at least one guide means engageable with the guide slot, the at least one guide means being fixably connectable to the runner rail.

2. The fitting according to claim 1, wherein the guide slot comprises two slot ends and two opposite vertical lateral surfaces, and wherein the guide slot is open on the two opposite vertical lateral surfaces.

3. The fitting according to claim 2, wherein the guide slot is closed at both ends of the slot.

4. The fitting according to claim 2, wherein the guide slot is rectilinear over its entire length.

5. The fitting according to claim 2, wherein the guide means is in the form of a substantially rectangularly defined plate having longitudinal sides, whose thickness is at most equal to the distance between confronting walls defining the guide slot.

6. The fitting according to claim 5, wherein on at least one of the longitudinal sides of the plate, mounting means are provided for fastening the plate on the corresponding runner rail in a desired sloping inclination.

7. The fitting according to claim 6, wherein the mounting means is formed of at least one short pin set directly or indirectly on the plate-like guide means, and wherein the pins are attachable each in an associated hole in a wall of the runner rail.

8. The fitting according to claim 6, further comprising a confronting surface and bottom of the plate forming the guide means and on an associated slot-defining wall, a transverse serration, and at least one, preferably several, transverse narrow rib tapering toward a free end and at a distance apart from one another.

9. The fitting according to claim 8, wherein the serration is formed on the bottom of the plate forming the guide means and faces away from the bearing surface, and the transverse rib(s) are provided on boundary surface(s) of the guide slot facing it.

10. The fitting according to claim 2, wherein the elongated body forming the slider is concavely curved trough-like at end surfaces of the slider.

11. The fitting according to claim 10, wherein the concavely curved trough-like end surfaces of the slider have each a superficial shape preventing the slippage of fingers engaging them.

12. The fitting according to claim 2, wherein the slider is a plastic injection-molded part.

13. The fitting according to claim 2, wherein the guide means are made of metal.

14. The fitting according to claim 13, wherein the mounting means is formed of at least one short pin set directly or indirectly on the plate-like guide means, and wherein the pins are attachable each in an associated hole in a wall of the runner rail.

15. A drawer supported at its bottom by runner rails on drawer slides, said drawer being adjustably mounted on said runner rails of drawer slides such that the height of the drawer is adjustable with respect to said runner rails, comprising;

a drawer bottom having a top and a bottom side, at least one runner rail disposed on the bottom side of the drawer bottom, the at least one runner rail being slidably connectable to a drawer slide, at least one movable fitting for the adjustable-height mounting of the drawer on the runner rails of the drawer slides supporting the drawer at the drawer bottom, said drawer having an opening direction, said fitting comprising a slider having an elongated body and having an elongated bearing surface for contacting the bottom of the drawer, the elongated body having a longitudinal guide slot running at an incline with respect to the bearing surface, and at least one guide means engageable with the guide slot, the at least one guide means being fixably connectable to the runner rail.

* * * * *